United States Patent [19]

Rosenberg

[11] 3,988,219

[45] Oct. 26, 1976

[54] BATHS AND ADDITIVES FOR THE ELECTRODEPOSITION OF BRIGHT ZINC

[75] Inventor: William E. Rosenberg, Strongsville, Ohio

[73] Assignee: Columbia Chemical Corporation, Cleveland, Ohio

[22] Filed: July 7, 1975

[21] Appl. No.: 593,310

[52] U.S. Cl. ..... 204/55 R; 204/DIG. 2; 260/2 BP

[51] Int. Cl.[2] ..... C25D 3/22

[58] Field of Search ..... 204/55 R, 55 Y, 43 Z, 204/44, DIG. 2; 260/2 A, 2 BP

[56] References Cited

UNITED STATES PATENTS

| | | | |
|---|---|---|---|
| 2,383,798 | 8/1945 | Hull | 204/50 Y |
| 3,026,270 | 3/1962 | Robinson | 260/2 A |
| 3,251,852 | 5/1966 | De Groote et al. | 260/2 A X |
| 3,577,313 | 5/1971 | Bolger et al. | 260/2 BP X |
| 3,625,684 | 12/1971 | Poot et al. | 260/2 A X |
| 3,746,678 | 7/1973 | Dick et al. | 260/2 A |
| 3,803,008 | 4/1974 | Rosenberg et al. | 204/55 Y |
| 3,824,158 | 7/1974 | Rosenberg | 204/55 R |
| 3,838,026 | 9/1974 | Koch | 204/55 R |
| 3,853,718 | 12/1974 | Creutz | 204/55 R |
| 3,869,358 | 3/1975 | Nobel et al. | 204/55 Y |

FOREIGN PATENTS OR APPLICATIONS

| | | | |
|---|---|---|---|
| 1,910,466 | 9/1970 | Germany | 204/55 R |
| 17,630 | 9/1972 | Japan | 204/55 R |

*Primary Examiner*—G. L. Kaplan
*Attorney, Agent, or Firm*—Oldham & Oldham Co.

[57] ABSTRACT

It has been found that aminated polyepichlorohydrins prepared by reacting polyepichlorohydrin with an amine selected from the group consisting of secondary aliphatic amines and secondary alicyclic amines result in a zinc electroplating bath brightener. Additionally, an aqueous, acid electroplating bath containing the aminated polyepichlorohydrin as well as polyoxyethylene condensates, and aromatic aldehydes and ketones act synergistically to provide bright, lustrous electrodeposits of zinc.

28 Claims, No Drawings

BATHS AND ADDITIVES FOR THE ELECTRODEPOSITION OF BRIGHT ZINC

BACKGROUND OF THE INVENTION

The present invention relates to a zinc electroplating bath brightener and to improvements in the electrodeposition of zinc from aqueous, acid plating baths.

Heretofore, certain characteristics of conventionally utilized acid zinc bath formulations have rendered them in many instances somewhat impractical to use. For example, the bath formulations disclosed in U.S. Pat. No. 3,694,330, has a limiting factor in that only a rather low current density can be applied to a given article to produce a lustrous zinc deposit. Should the current density be raised to increase the speed of plating, very dark, course deposits of zinc would be plated on the article. Another common problem is that which occurs in using the bath formulations of U.S. Pat. No. 3,723,263 in that at bath temperatures of above 95° F, the formulations encounter a severe loss of brightening ability.

Since electroplaters often prefer to plate at quite high current densities to facilitate high plating rates, a broad plating range and high bath temperature tolerance are very important.

SUMMARY OF THE INVENTION

Accordingly, it is an object of the present invention to provide brightening agents which produce extremely bright electrodeposits of zinc over a very wide current density range and at relatively high bath temperatures.

It is a further object of the present invention to produce an extremely bright electrodeposit of zinc, through the utilization of an aminated polyepicholohydrin compound.

It is yet another object of the present invention to produce an extremely bright electrodeposit of zinc through the synergistic combination of an aminated polyepichlorohydrin, an ethylene oxide condensation product and an aromatic aldehyde or ketone. These and other objects of the present invention, together with the advantages thereof over existing prior art formulations which will become apparent from the following specification, are accomplished by the compounds, formulations, and methods herein described and claimed.

In general, a zinc brightener additive for an aqueous, acid zinc electroplating bath comprises, an aminated polyepichlorohydrin, said polyepichlorohydrin prepared by reacting from about 1.0 to about 2.0 of a stoichiometric amount of a polyepichlorohydrin based on the chloromethyl groups with an amine selected from the group consisting of secondary aliphatic amines and secondary alicyclic amines to form a polytertiary amine. That is, the amount of the amine is regulated on a molar basis so that between 50 percent and 100 percent of the chloro groups in the polyepichlorohydrin are reacted. Thus, if the stoichiometric amount of the polyepichlorohydrin is about 1.0, then about 100 percent of the chloro groups will be reacted whereas if the stoichiometric amount of the polyepichlorohydrin to the amine is about 2.0, then only about 50 percent of the chloro groups in the polyepichlorohydrin will be reacted. Preferably said amines have from 2 to about 6 carbon atoms.

The invention also relates to an aqueous, acid zinc electroplating bath for producing a bright electrodeposit of zinc, containing, zinc ions, comprising, having dissolved therein from about 1 to about 10 grams/liter of aminated polyepichlorohydrin, from about 1 to about 10 grams/liter of an ethylene oxide condensation product, and from about 0.05 to about 0.5 grams per liter of at least one compound selected from the group consisting of aromatic aldehydes and aromatic ketones.

DESCRIPTION OF THE PREFERRED EMBODIMENTS

According to the concepts of the present invention, it has been found that aminated polyepichlorohydrins are a very effective zinc brightener. Additionally, it has been found that when the aminated polyepichlorohydrin brightener is added to an aqueous, acid zinc electroplating bath along with an ethylene oxide condensation product and an aromatic aldehyde or aromatic ketone, synergistic and extremely bright electrodeposits of zinc are produced over a very broad plating range and at relatively high bath temperatures. The effect is truly synergistic in that the results obtained with this combination far exceed the results obtained by using these compounds alone or in any combination of only two.

Epichlorohydrin polymers of various molecular weights are currently available in commerce and the technology for their preparation is extensively divulged in numerous papers and articles found in the chemical literature. A very wide range of molecular weights of polyepichlorohydrin is acceptable for use in this invention such as from 1,000 to about 20,000, and the preferred molecular weight range is from about 1,000 to about 5,000.

Amination of polyepichlorohydrin to obtain a tertiary amine can be accomplished by carefully heating a secondary amine such as a secondary aliphatic amine or a secondary alicyclic amine preferably having from 2 to about 6 carbon atoms, and polyepichlorohydrin at temperatures ranging from about 110° to about 170° C and preferably from about 120° C to 150° C for at least one hour to about eight hours with good stirring. The amount of the amine is regulated on a molar basis so that between 50 percent and 100 percent of the chloro groups in the polyepichlorohydrin are reacted. In the case where a highly volatile amine is used, the reaction desirably is carried out in a suitable vessel under pressure in order to obtain the required temperatures and avoid losing a low boiling reactant. More specifically, the amination of polyepichlorohydin can be prepared according to methods set forth in U.S. Pat. No. 3,824,158 as in Examples I and II, which patent is hereby fully incorporated by reference, paticularly with respect to the said method of preparation.

Listed in Table I are specific examples of secondary aliphatic and alicyclic amines which may be utilized to form the aminated polyepichlorohydrins.

TABLE I

| | |
|---|---|
| 1. | Dimethylamine |
| 2. | Diethylamine |
| 3. | Dipropylamine |
| 4. | Diisopropylamine |
| 5. | Methylethylamine |
| 6. | Methyl propylamine |
| 7. | Methyl isopropylamine |
| 8. | Ethyl isopropylamine |
| 9. | N-methyl ethanolamine |
| 10. | N-methyl propanolamine |
| 11. | N-methyl isopropanolamine |
| 12. | N-ethyl propanolamine |
| 13. | N-ethyl isopropanolamine |
| 14. | N-propyl propanolamine |

TABLE I-continued

| | |
|---|---|
| 15. | N-propyl isopropanolamine |
| 16. | N-isopropyl isopropanolamine |
| 17. | Diethanolamine |
| 18. | Dipropanolamine |
| 19. | Diisopropanolamine |
| 20. | Morpholine |
| 21. | Piperidine |

The aminated polyepichlorohydrin compounds of this invention are used at a concentration of about 1 to 10 grams/liter of plating bath and the preferred amount is about 5 grams/liter. They are generally added as aqueous solutions for convenience in handling. Additionally, methanol, ethanol and isopropanol may be utilized.

The ethylene oxide condensation products of this invention are readily available in commerce. They are used at a concentration of about 1 to about 10 grams/liter of bath and the preferred amount is about 5 grams/liter. They are prepared by condensing at least six moles and up to about 30 moles of ethylene oxide per mole of long chain fatty alcohol, long chain fatty acid, long chain fatty amine, long chain alkyl phenol, or naphthol. Long chain is defined here as an aliphatic chain of at least 6 carbon atoms and up to about 30 carbon atoms. Preferably from 6 carbon atoms to 20 carbon atoms are utilized. Of the two naphthols that are possible, the beta naphthol is the preferred choice. Of course, many long chain groups exist such as lauryl, stearyl, nonyl and the like. Additional groups or compounds are well within the knowledge of one skilled in the art. These ethylene oxide condensation products may either be added separately as an aqueous solution or added as a part of an additive brightener wherein there is present from about 1 to about 99 percent by weight of the ethylene oxide condensation product.

The choice of aromatic aldehydes and aromatic ketones is quite broad. Table II lists some specific preferred aldehydes and ketones of this invention. Concentrations of from about 0.05 to about 0.5 grams/liter of plating bath may be used with the preferred amount being about 0.1 grams/liter. Benzylidene acetone has been found to give the best results and is therefore the highly preferred.

TABLE II

| | |
|---|---|
| 1. | Benzylidene acetone |
| 2. | Vanillan |
| 3. | Heliotropin |
| 4. | Anisaldehyde |
| 5. | Veratraldehyde |
| 6. | Acetophenone |
| 7. | Acetonapthone |
| 8. | Cinnamic aldehyde |
| 9. | 2-chlorobenzaldehyde |

The aldehydes and ketones can be added in concentrated form, but are more conveniently added as a 1 to 20 percent by weight solution in a suitable solvent such as methanol or ethanol. They can also be added as a part of an additive brightener wherein there is present from about 1 to about 20 percent by weight of the aromatic aldehyde or aromatic ketone.

Generally, the source of zinc ions may be from any zinc salt such as zinc sulfate, zinc acetate, etc, with zinc chloride being preferred. A suitable concentration of zinc ions is from 7.5 to about 40 grams/liter. Additionally, a pH range of about 4.0 to about 6.3 is desired for good plating results. Of course, the use of ammonium chloride is highly preferred and a desirable range is from 100 to 300 grams/liter.

While the addition agents of this invention are effective in many aqueous, acid zinc plating bath formulations, it is preferred to use any of the basic baths described in the following examples. It will be understood that the following examples are just illustrations and are not meant to limit the use of the invention to only these bath compositions.

EXAMPLE I

| BATH COMPOSITION | CONCENTRATION In Grams/Liter |
|---|---|
| Zinc Chloride | 30 |
| Ammonium chloride | 200 |
| pH=5.0 | |
| Aminated polyepichlorohydrin wherein the amine is dimethylamine | 6 |
| Beta Naphthol condensed with 12 moles of ethylene oxide | 5 |
| Benzylidene acetone | 0.1 |

EXAMPLE II

| BATH COMPOSITION | CONCENTRATION In Grams/Liter |
|---|---|
| Zinc Sulfate | 40 |
| Ammonium chloride | 180 |
| pH=6.0 | |
| Aminated polyepichlorohydrin wherein the amine is morpholine | 4 |
| Nonyl phenol condensed with 14 moles of ethylene oxide | 5 |
| Benzylidene acetone | 0.2 |

EXAMPLE III

| BATH COMPOSITION | Concentration in Grams/Liter |
|---|---|
| Zinc Chloride | 30 |
| Ammonium chloride | 180 |
| pH=5.5 | |
| Aminated polyepichlorohydrin wherein the amine is piperidine | 5 |
| Nonyl alcohol condensed with 10 moles of ethylene oxide | 6 |
| Benzylidene acetone | 0.1 |

All testing was done in a conventional 267 ml. Hull cell using steel cathode panels and a zinc anode. Three ampere panels were run for five minutes at temperatures ranging from 70° F to 150° F with mechanical agitation. The test results from baths of Examples I, II, and III, along with comparative bath compositions are given in Table III.

TABLE III

| Bath Composition | Results |
|---|---|
| Bath of Example I | Extremely bright from about zero to well over 175 amps./sq.ft. |
| Bath of Example II | Bright from about zero to well over 175 amps./sq.ft. |
| Bath of Example III | Bright from about zero to well over 175 amps./sq.ft. |
| Bath of Example I, but without aminated polyepichlorohydrin | Semibright to bright from about zero to 45 amps./sq.ft. and dark, spongy deposits above 45 amps./sq.ft. with no brightness. |
| Bath of Example III, but without aminated polyepichlorohydrin | Semibright from about 5 to 40 amps./sq.ft. and dark, spongy deposits above 40 amps./sq.ft. with no brightness. |
| Bath of Example I, but without the ethylene oxide condensate | Very dark, irregular plate from about zero to 80 amps./sq.ft. with many random areas of no plate. |
| Bath of Example I, but without benzylidene acetone | Very dull from about zero to 30 amps./sq.ft., semibright with a yellowish cast from 30 to about 120 amps./sq.ft., and very course and dull above 120 amps./sq.ft. |
| Bath of Example III, but without benzylidene acetone | Very dull from about zero to 40 amps./sq.ft., from dull to semi-bright between 40 and 100 amps./sq.ft., and course and dull above 100 amps./sq.ft. |
| Bath of Example I, but without benzylidene acetone and ethylene oxide condensate | Dark, spongy deposits at all current densities. |

Having thus described the invention in such full, clear, concise, and exact terms as to enable any person skilled in the art to make it pertains to make and use the same and having set forth the best mode contemplated of carrying out this invention in accordance with the present statures, the subject matter of the invention is limited to the claims, it being understood that equivalents or modifications of, or substitutions for, parts of the above specifically described embodiment of the invention may be made without departing from the scope of the invention as set forth in the claims.

What is claimed is:

1. A zinc brightener additive for an aqueous, acid zinc electroplating bath, comprising, an aminated polyepichlorohydrin, said polyepichlorohydrin prepared by reacting polyepichlorohydrin with an amine selected from the group consisting of secondary aliphatic amines and secondary alicyclic amines at a temperature of from about 110° C to about 170° C, the amount of said amines is such so that between 50 percent to 100 percent of the chloro groups in said polyepichlorohydrin is reacted, and from about 1 to about 99 percent by weight of an ethylene oxide condensation product wherein from about 6 to about 30 moles of ethylene oxide are condensed with 1 mole of a compound selected from the group consisting of a long chain fatty alcohol, a long chain fatty amine, a long chain fatty acid, a long chain alkyl phenol, and naphthol.

2. A zinc additive according to claim 1 including from about 1 percent to about 20 percent by weight of an aromatic aldehyde or aromatic ketone.

3. A zinc additive brightener according to claim 2, wherein said aromatic ketone is benzylidene acetone.

4. A zinc additive brightener according to claim 1, wherein said amine is selected from the group consisting of dimethylamine, diethylamine, dipropylamine, diisopropylamine, methylethylamine, methyl propylamine, methyl isopropylamine, ethyl isopropylamine, N-methyl ethanolamine, N-methyl propanolamine, N-ethyl isopropanolamine, N-propyl propanolamine, N-propyl isopropanolamine, N-isopropyl isopropanolamine, diethanolamine, dipropanolamine, diisopropanolamine, morpholine, and piperidine.

5. A zinc brightener additive according to claim 4, wherein the molecular weight of said aminated polyepichlorohydrin ranges from about 1,000 to about 20,000.

6. A zinc additive brightener according to claim 1, wherein said ethylene oxide condensation product is a product resulting from a condensation of ethylene oxide and beta naphthol.

7. A zinc additive brightener according to claim 6, wherein there is present benzylidene acetone and the amount of said benzylidene acetone ranges from about 1 to about 20 percent by weight.

8. A zinc brightener additive according to claim 7, wherein said amine is selected from the group consisting of dimethylamine, diethylamine, dipropylamine, diisopropylamine, methylethylamine, methyl propylamine, methyl isopropylamine, ethyl isopropylamine, N-methyl ethanolamine, N-methyl propanolamine, N-ethyl isopropanolamine, N-propyl propanolamine, N-propyl isopropanolamine, N-isopropyl isopropanolamine, diethanolamine, dipropanolamine, diisopropanolamine, morpholine, and piperidine.

9. A zinc additive brightener according to claim 1, wherein said ethylene oxide condensation product is a product resulting from the condensation of ethylene oxide and a compound selected from the group consisting of a long chain fatty alcohol, a long chain fatty amine, a long chain fatty acid and a long chain alkyl phenol.

10. A zinc additive brightener according to claim 9, wherein there is present benzylidene acetone and wherein said benzylidene acetone ranges from about 1 percent to about 20 percent by weight.

11. A zinc brightener additive according to claim 10, wherein said amine is selected from the group consisting of dimethylamine, diethylamine, dipropylamine, diisopropylamine, methylethylamine, methyl propylamine, methyl isopropylamine, ethyl isopropylamine, N-methyl ethanolamine, N-methyl propanolamine, N-ethyl isopropanolamine, N-propyl propanolamine, N-propyl isopropanolamine, N-isopropyl isopropanolamine, diethanolamine, dipropanolamine, diisopropanolamine, morpholine, and piperidine.

12. An aqueous, acid zinc electroplating bath containing zinc ions for producing a bright electrodeposit of zinc comprising, having dissolved therein from about 1 to about 10 grams/liter of aminated polyepichlorohydrin, from about 1 to about 10 grams/liter of an ethylene oxide condensation product, and about 0.05 to about 0.5 grams/liter of at least one compound selected from the group consisting of aromatic aldehyde and aromatic ketone.

13. The bath of claim 12, wherein said aminated polyepichlorohydrin is prepared by reacting polyepichlorohydrin with an amine selected from the group consisting of secondary aliphatic amines and secondary alicyclic amines at a temperature of about 110° C to about 170° C, the amount of said amines is such so that between 50 percent and 100 percent of the chloro groups of said polyepichlorohydrin are reacted.

14. The bath of claim 13, wherein said ethylene oxide condensation product is formed by condensing at least 6 to about 30 moles of ethylene oxide with 1 mole of a compound selected from the group consisting of a long chain fatty alcohol, a long chain fatty amine, a long chain fatty acid and a long chain alkyl phenol wherein said long chain has from 6 to about 30 carbon atoms and naphthol.

15. A bath according to claim 14, wherein the pH of the solution is from about 4.0 to about 6.3.

16. A bath according to claim 15, wherein said secondary aliphatic amine and said secondary alicyclic amine is selected from the group consisting of dimethylamine, diethylamine, dipropylamine, diisopropylamine, methylethylamine, methyl propylamine, methyl isopropylamine, ethyl isopropylamine, N-methyl ethanolamine, N-methyl propanolamine, N-methyl isopropanolamine, N-ethyl propanolamine, N-ethyl isopropanolamine, N-isopropyl isopropanolamine, diethanolamine, dipropanolamine, diisopropanolamine, morpholine, and piperidine.

17. The bath of claim 16, wherein said ethylene oxide is condensed with a compound selected from the group consisting of beta naphthol, nonyl phenol, and nonyl alcohol.

18. The bath of claim 15, wherein said aromatic aldehydes and aromatic ketones are selected from the group consisting of benzylidene acetone, vanillan, heliotropin, anisaldehyde, veratraldehyde, acetophenone, acetonaphthone, cinnamic aldehyde, 2-chlorobenzaldehyde, and 2,6-dichlorobenzaldehyde.

19. The bath composition of claim 18, wherein said amines have from 2 to about 6 carbon atoms.

20. The bath of claim 18, wherein said temperature is from about 120° C to about 150° C.

21. The bath of claim 20, wherein said ethylene oxide condensation product is a product resulting from the condensation of ethylene oxide and beta naphthol.

22. The bath of claim 21, wherein said aromatic ketone is benzylidene acetone.

23. The bath of claim 20, wherein the molecular weight of said polyepichlorohydrin is from about 1,000 to about 20,000.

24. The bath of claim 20, wherein the molecular weight of said polyepichlorohydrin is from about 1,000 to about 5,000.

25. The bath composition of claim 18, wherein the aromatic ketone is benzylidene acetone.

26. The bath of claim 18, including ammonium chloride.

27. The bath of claim 26, including from about 100 to about 300 grams per liter of ammonium chloride.

28. The bath of claim 18, wherein the range of zinc ions is from about 7.5 to about 40 grams per liter.

* * * * *